US008397387B2

(12) United States Patent
Cole et al.

(10) Patent No.: US 8,397,387 B2
(45) Date of Patent: Mar. 19, 2013

(54) AUTOMATED FOAM PANEL APPARATUS, BLADE, AND ASSOCIATED METHOD

(75) Inventors: Kenneth R. Cole, Cassville, MO (US); Keith Leroy Cole, Cassville, MO (US); John Ray Cole, Cassville, MO (US)

(73) Assignee: Systeco Ltd SECZ, Springfield, MO (US)

( * ) Notice: Subject to any disclaimer, the term of this patent is extended or adjusted under 35 U.S.C. 154(b) by 1121 days.

(21) Appl. No.: 12/218,678

(22) Filed: Jul. 17, 2008

(65) Prior Publication Data

US 2010/0011701 A1 Jan. 21, 2010

(51) Int. Cl.
*B21D 49/00* (2006.01)
*E04G 21/14* (2006.01)

(52) U.S. Cl. ..... 29/897.34; 52/749.1

(58) Field of Classification Search ..... 29/557, 29/558, 564.2, 897, 897.3, 897.32, 897.34; 52/749.1, 745.19; 219/233; 269/236
See application file for complete search history.

(56) References Cited

U.S. PATENT DOCUMENTS 3,526,750 A * 9/1970 Siegel ..... 219/233
3,757,617 A 9/1973 Fabbri
3,901,110 A 8/1975 Priestly
3,994,065 A 11/1976 Plum
4,070,013 A * 1/1978 Sickler ..... 269/236
4,288,271 A 9/1981 Campbell, et al.
4,385,090 A 5/1983 Sims
4,596,066 A 6/1986 Inoue
4,608,103 A 8/1986 Aldrich
4,608,893 A 9/1986 Huhne
4,641,469 A 2/1987 Wood
4,675,825 A 6/1987 DeMenthon
4,699,032 A 10/1987 Clark
4,823,534 A 4/1989 Hebinck
4,892,018 A 1/1990 Boggs
4,952,450 A 8/1990 Noel
5,072,569 A 12/1991 VanTassel
5,172,532 A 12/1992 Gibbar
5,323,573 A 6/1994 Bakewell
5,353,560 A 10/1994 Heydon
5,487,248 A 1/1996 Artzer
5,505,031 A 4/1996 Heydon
5,617,686 A 4/1997 Gallagher
5,653,032 A 8/1997 Sikka
5,765,333 A 6/1998 Cunningham
5,771,645 A 6/1998 Porter
5,822,940 A 10/1998 Carlin et al.
5,842,276 A 12/1998 Asher
5,943,775 A 8/1999 Lanahan
5,965,207 A 10/1999 Kropfeld et al.
(Continued)

OTHER PUBLICATIONS

Kenneth R. Cole, "Straight Line Foam Profile Cutting Machine," Dec. 6, 2006, confidential, internal document prepared for research and development of experimental machine.

*Primary Examiner* — John C Hong
(74) *Attorney, Agent, or Firm* — Husch Blackwell LLP

(57) ABSTRACT

An apparatus and associated method for constructing prefabricated foam panels is provided. While making a longitudinal pass over a foam block, the apparatus flattens the foam block, cuts longitudinal kerfs in the foam block, and draws metal studs into the kerfs. The apparatus comprises a unique, heated blade having a shape similar to the cross section of a metal stud. The blade kerfs foam blocks, including blocks made of recycled or low-grade foam. The associated method includes kerfing the foam blocks by passing the blade through the foam blocks and drawing metal studs into the kerfs.

8 Claims, 10 Drawing Sheets

U.S. PATENT DOCUMENTS

| | | | |
|---|---|---|---|
| 6,018,922 | A | 2/2000 | McKinnon |
| 6,142,053 | A | 11/2000 | Denney et al. |
| 6,167,624 | B1 | 1/2001 | Lanahan |
| 6,251,319 | B1 | 6/2001 | Tusim |
| 6,253,523 | B1 | 7/2001 | McKinnon |
| 6,272,749 | B1 | 8/2001 | Boeshart et al. |
| 6,358,344 | B1 | 3/2002 | Hunter |
| 6,412,243 | B1 | 7/2002 | Sutelan |
| 6,416,854 | B2 | 7/2002 | Hunter |
| 6,571,523 | B2 | 6/2003 | Chambers |
| 6,581,348 | B2 | 6/2003 | Hunter |
| 6,627,030 | B2 | 9/2003 | Yang et al. |
| 6,702,918 | B2 | 3/2004 | Yang et al. |
| 6,722,611 | B1 | 4/2004 | Wu et al. |
| 6,725,616 | B1 | 4/2004 | Pease |
| 6,892,507 | B1 | 5/2005 | Pease |
| 6,945,002 | B2 | 9/2005 | Zambelli |
| 6,970,765 | B1 | 11/2005 | Greene |
| 7,028,440 | B2 | 4/2006 | Brisson |
| 7,127,856 | B2 | 10/2006 | Hagen |
| 7,162,847 | B2 | 1/2007 | Gigakos |
| 7,168,216 | B2 | 1/2007 | Hagen |
| D554,673 | S | 11/2007 | Cheng |
| 2002/0061497 | A1 | 5/2002 | Boudreaux et al. |
| 2002/0184846 | A1 | 12/2002 | Crowder |
| 2004/0107652 | A1 | 6/2004 | Elliott |
| 2004/0128932 | A1 | 7/2004 | Estape |
| 2004/0188031 | A1 | 9/2004 | Barman |
| 2006/0065152 | A1 | 3/2006 | Keitmeyer et al. |
| 2007/0119118 | A1 | 5/2007 | Gigiakos |

* cited by examiner

FIG. 1
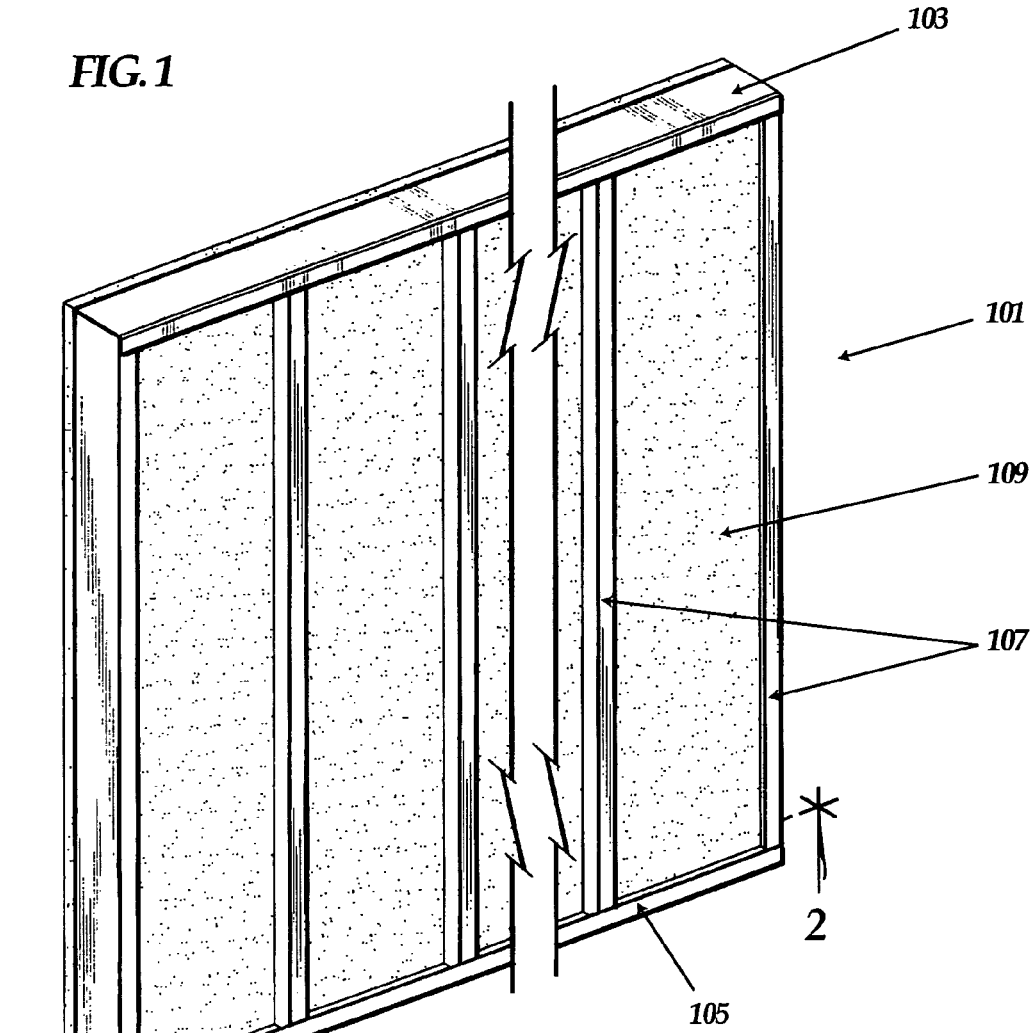
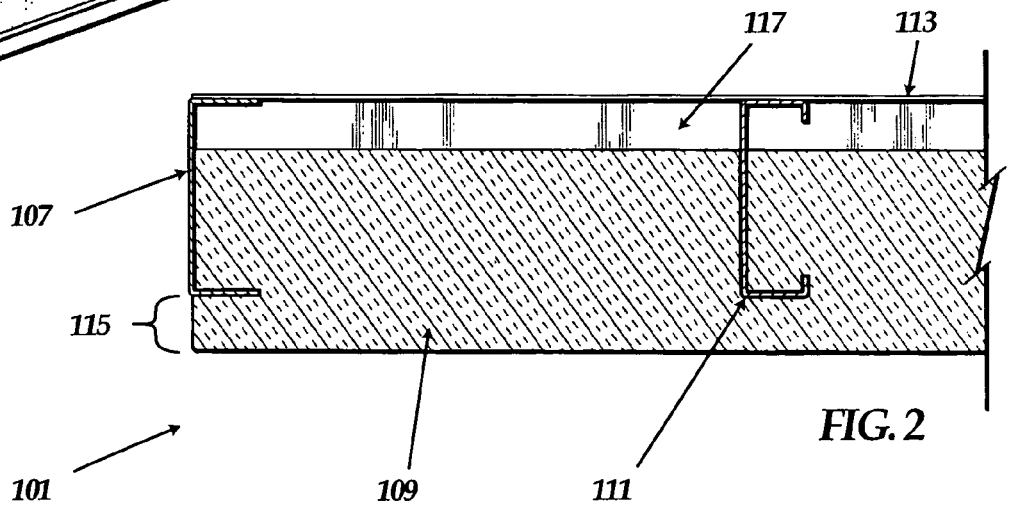
FIG. 2

AUTOMATED FOAM PANEL APPARATUS, BLADE, AND ASSOCIATED METHOD

CROSS REFERENCES

None.

GOVERNMENTAL RIGHTS

None.

BACKGROUND OF THE INVENTION

Historically, buildings were constructed out of natural resources that were readily and locally available, such as mud, wood, sod, or stone. These materials present a number of disadvantages, including relatively low structural integrity, the requirement of skilled artisans to assemble the materials, the lengthy amount of time involved in assembling the materials, and the need to independently insulate the building. Recently, builders developed updated building materials, including prefabricated building panels made of metal studs and foam insulation. The invention relates to improved methods of constructing prefabricated metal stud and foam panels.

One type of foam panel is made by kerfing a block of foam using a hot wire cutter. As shown in U.S. Pat. No. 6,167,624, issued to Lanahan et al., hot wire cutters are machines that heat tensioned wires measuring slightly longer than the length of the foam blocks to be cut. The foam block is secured in place while the superheated wire enters the foam block, cuts a trace of the outline of the stud, and exits the foam block. The result is a kerf that is approximately the same size and shape as the cross-section of the stud. Because hot wire cutters span and kerf the entire length of a foam block at once, they leave a slug that also spans the length of the foam block that must be removed prior to inserting the stud. The removal of the longitudinal slug must be performed manually, which constitutes a disadvantage to the use of hot wire cutters. It is an object of the invention to provide a process for constructing a foam panel that does not require manual removal of a longitudinal slug or manual installation of a stud.

Hot wire cutters also produce an inconsistent cut across the entire length of a foam block. Hot wire cutters are supposed to perform a straight cut, but because wires stretch when heated, hot wire cutters require a tensioning mechanism to maintain a straight wire. The tensioning mechanism must be very precise, as too much tension will break a hot wire, and too little tension will result in a bowed wire and resulting erroneous kerf. In typical industrial applications, wires are fragile and must be replaced several times a week. It is thus an object of the invention to provide a process for constructing a foam panel that improves upon the relative unreliability of hot wire cutters of the prior art.

As hot wires used in foam cutting break easily due to tension fluctuations, great care must be taken with respect to the type of foam used. Hot wire cutters of the prior art are preferred only in cutting pure, new foam blocks because impurities in recycled foam cause varied tension of the wires, often breaking them. Even new foam, such as expanded polystyrene ("EPS"), that consists of millions of tiny beads can break hot wire cutters if the size of the beads are not substantially uniform. Generally speaking, foam (particularly EPS) is not easily recyclable and is not biodegradable, and hot wire cutters do nothing to alleviate this general concern. Thus, it is another object of the invention to provide a process for constructing a foam panel that is capable of utilizing recycled and lower-grade foam.

Because foam panels are in relatively wide use, especially in construction of commercial buildings, many localities have specific building codes directed to foam panels. These types of regulations address thermal bridging, which means that the heat conductivity of metal studs may allow heat to be transmitted into or out of a building. A typical regulation requires at least 1.5 inches of foam between a metal stud and the exterior surface of the panel. That is, the metal stud must be embedded at least 1.5 inches into the foam, as measured from the exterior surface, to meet typical regulations. It is another object of the invention to produce a metal stud and foam panel combination capable of reliably meeting building regulations.

Traditional methods of constructing foam panels are not well suited to meet regulations for metal studded foam panels. Foam, and particularly EPS, is produced in rectangular blocks, and the curing process creates a natural curvature in these blocks. Traditional processes measure to a depth of 1.5 inches on each side of a foam block and kerf a line between these two points; however, the wire-cutting method does not result in a uniform depth because it does not contemplate the natural and inconsistent curvature inherent in most if not all foam blocks. It is thus another object of the invention to provide a foam panel having a uniform kerf depth along the entire length of the foam block, regardless of the natural curvature of the initial foam block component.

Compounding the problem of irregularly curved foam blocks is the fact that the wires used in hot wire cutters bow when they are heated. That is, the center of the wire dips as the wire expands during heating. As a result, kerfs made using a hot wire cutter are typically bowed as well, thus exacerbating the unreliability of foam blocks cut by longitudinal wires. It is another object of the invention to provide a foam panel having straight and uniform kerfs for the insertion of metal studs along the entire length of the foam block.

The inventors have experimented with various methods of solving these problems of the prior art. In one prototype designed to kerf a foam block for receiving a metal stud, the inventors utilized a circular saw to kerf a channel for the main beam of a metal stud, and used a separate hot wire knife to form the portion of the kerf corresponding to the channel and lip of the stud. The inventors never considered this implementation ready to patent due to several serious drawbacks that rendered the implementation unfit for industrial use. The first drawback was that the circular saw created tiny particles of foam that were easily ignited by the saw, the hot wire, or both. Foam burns rapidly and reaches high temperatures quickly when ignited, and even more seriously, melted foam sticks to human skin, clothing, and any other surface. The saw can compound problems resulting from burning foam by discharging melted, burning foam as the saw continues to cut. Therefore, this implementation presented a serious industrial safety issue. The second drawback was that a hot wire had to be welded to a stiffener to assist in keeping the resulting knife in the appropriate shape. However, the wire portion of the knife still melted frequently (albeit not as frequently as a hot wire cutter alone) due to thinness, and the difference in expansion of the two different metals throughout the operating range of the knife accelerated the knife's failure. Furthermore, since the knife was comprised of two separate metals, the knife was more expensive to produce for a relatively small gain in reliability over hot wire cutters of the prior art. The third drawback of this implementation is that there was no way to ensure uniform depth of the studs from the outer surface of the foam. Fourth, metal studs still had to be inserted into the machine by hand, as the saws and knives remained stationary while the foam block was moved through the machine. It is thus an object of the invention to provide a safe, reliable, consistent automated foam panel-making machine.

BRIEF SUMMARY OF THE INVENTION

The invention provides an apparatus and associated method of creating a foam panel that avoids the pitfalls associated with constructing foam panels using a hot wire cutter. The apparatus and method utilize a blade having a novel shape that maintains such shape while passing through and making a longitudinal cut through the foam block. The rigidity of the blade according to the invention provides several advantages, including that the invention is capable of producing metal studded foam panels with recycled foam.

To operate the apparatus, a foam block is secured to a deck. A cuffing unit moves longitudinally across the foam block, flattening the foam block with rollers immediately prior to cutting a kerf into the block using a heated blade. Such process creates kerfs of a uniform depth, and the heated blade configuration leaves no slug. The apparatus may preferentially insert the metal studs into the block following the cutting process in the same longitudinal pass, which is advantageous because the insertion of metal studs also assists in maintaining a flat foam block for uniform kerf depth.

These and other advantages provided by the invention will become apparent from the following detailed description which, when viewed in light of the accompanying drawings, disclose the embodiments of the invention.

BRIEF DESCRIPTION OF THE DRAWINGS

FIG. 1 is a perspective view of a prefabricated foam panel.

FIG. 2 is a cross sectional view of a foam panel along the line 2-2 in FIG. 1.

LISTING OF COMPONENTS

Figure 3:
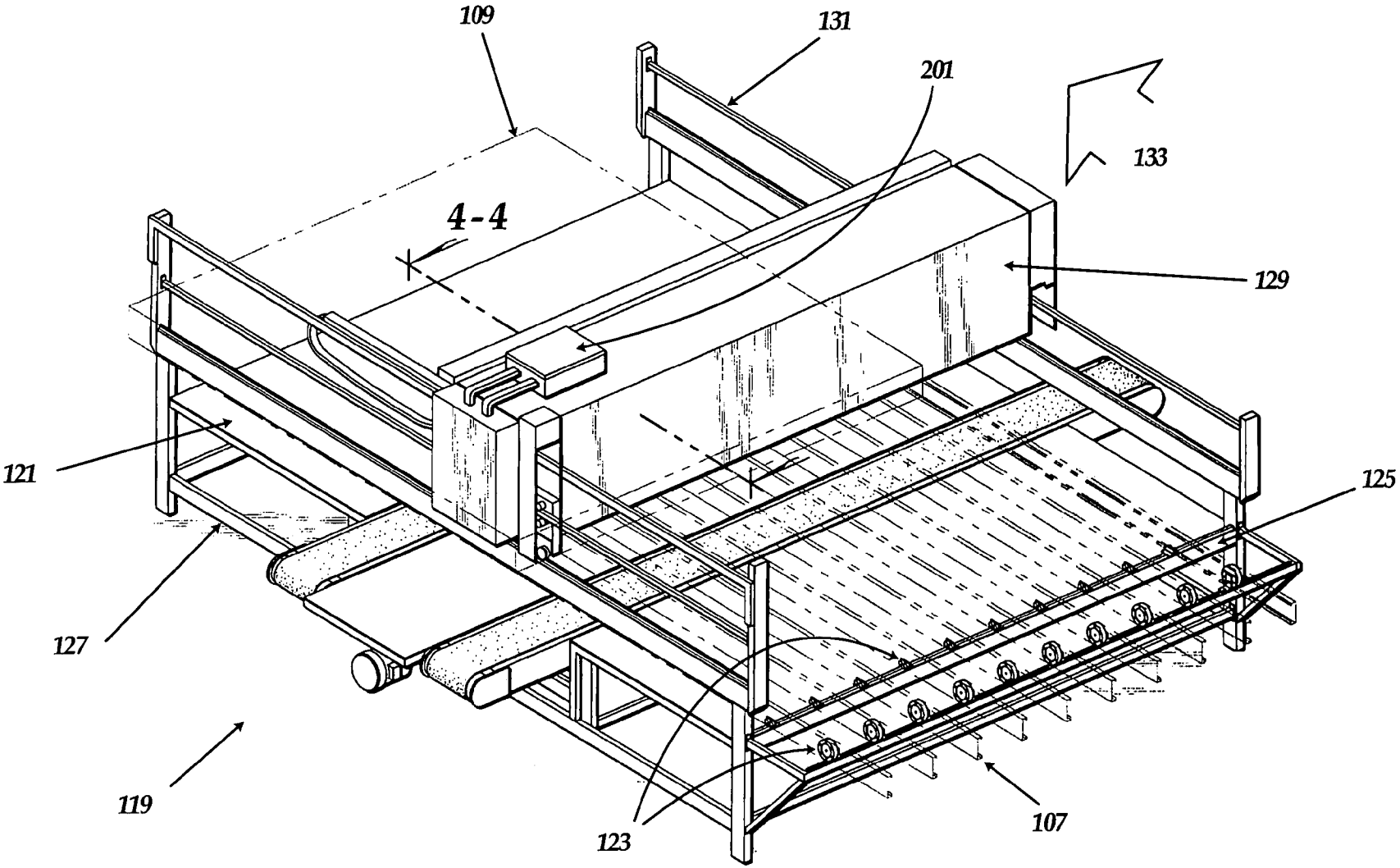
FIG. 3 is a perspective view of the automated foam panel machine used to practice the method disclosed herein.
Figure 4:
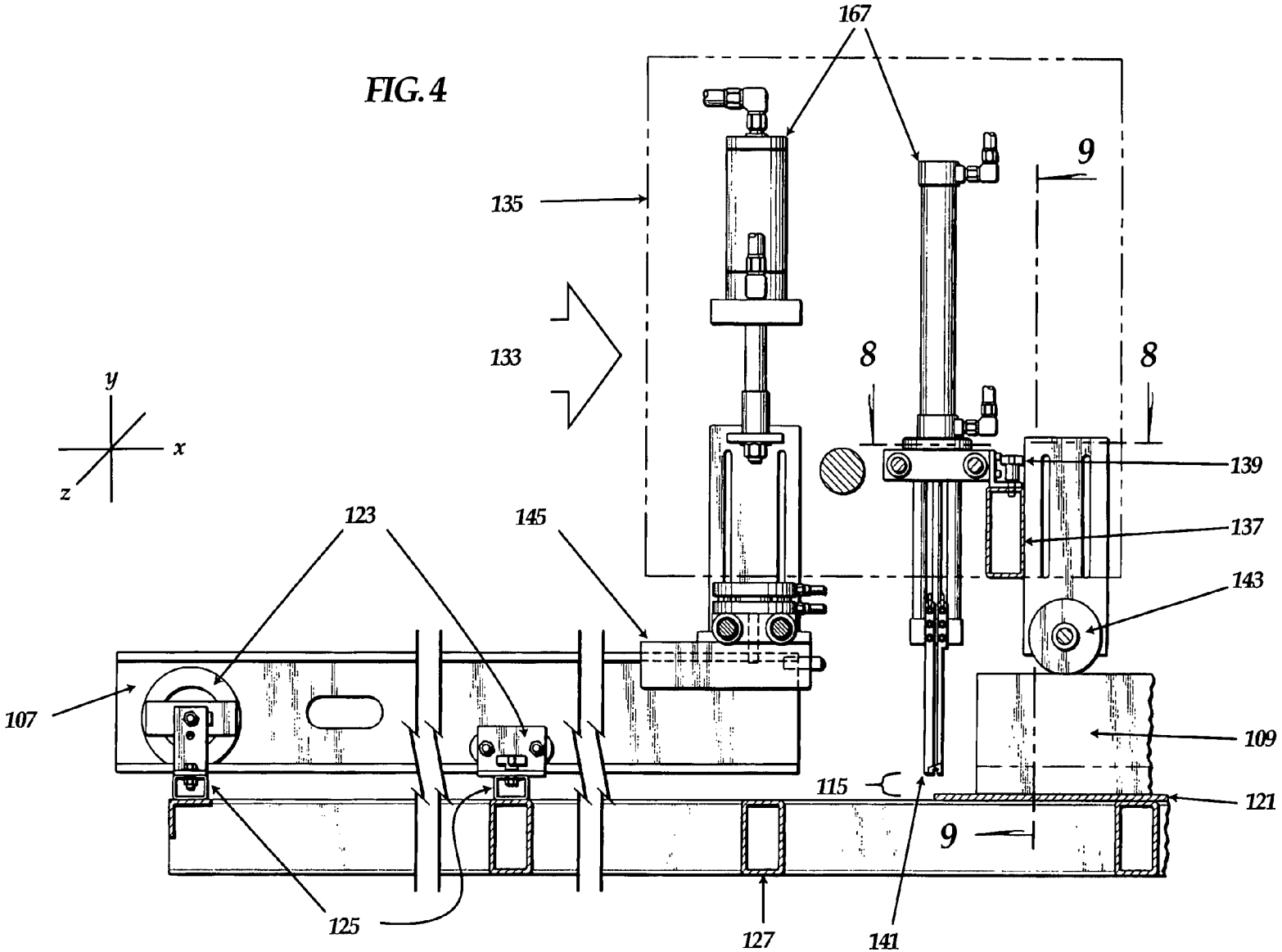
FIG. 4 is side view of the cutting unit used in the automated foam panel machine along the line 4-4 in FIG. 3 showing the configuration of the stud clamp, blade, and roller in relation to a stud and foam block.
Figure 5:
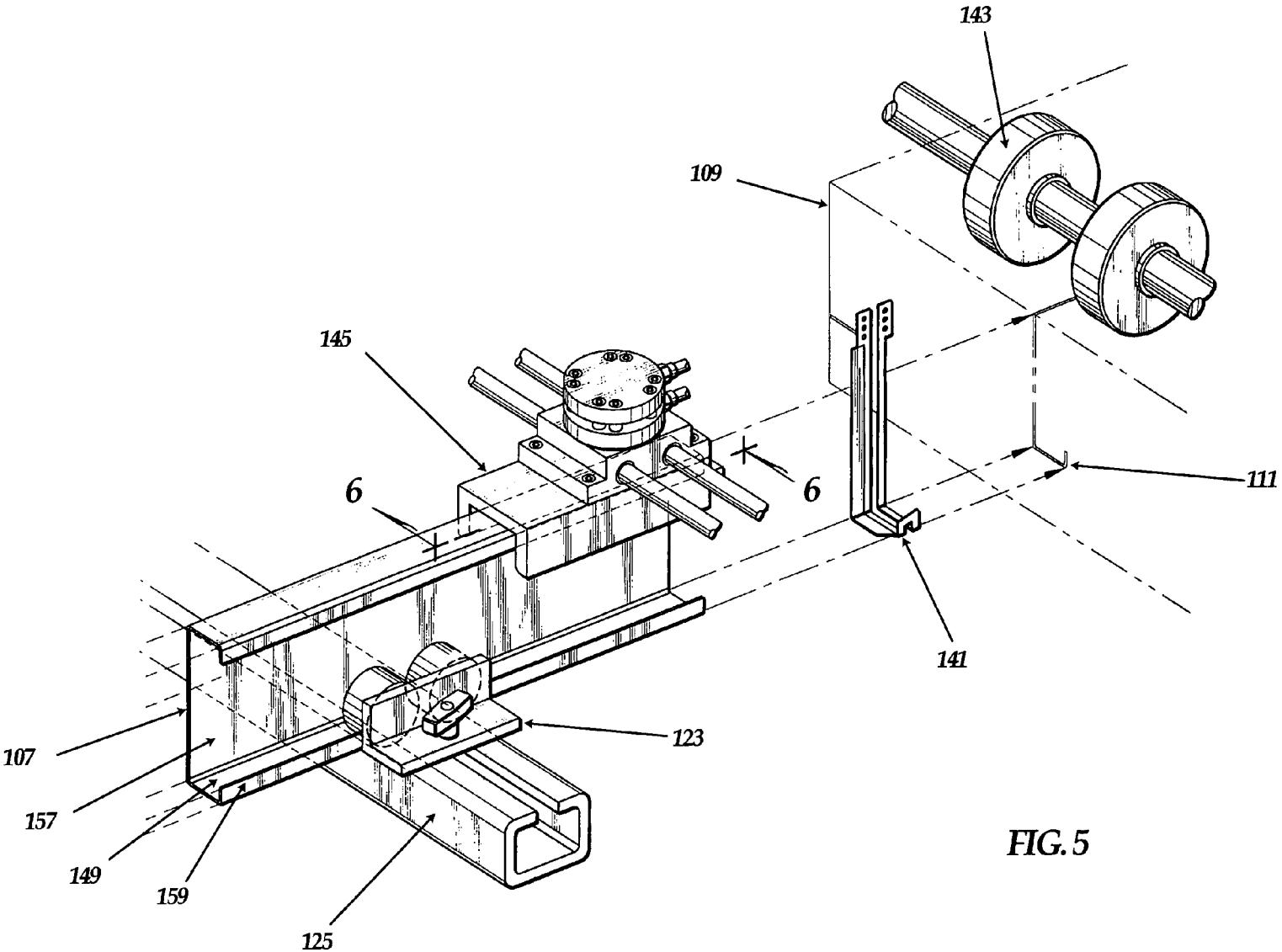
FIG. 5 is an exploded perspective view of the cutting unit showing the configuration of the stud roller, stud clamp, blade, and roller in relation to a stud, foam block, and kerf.
Figure 6:
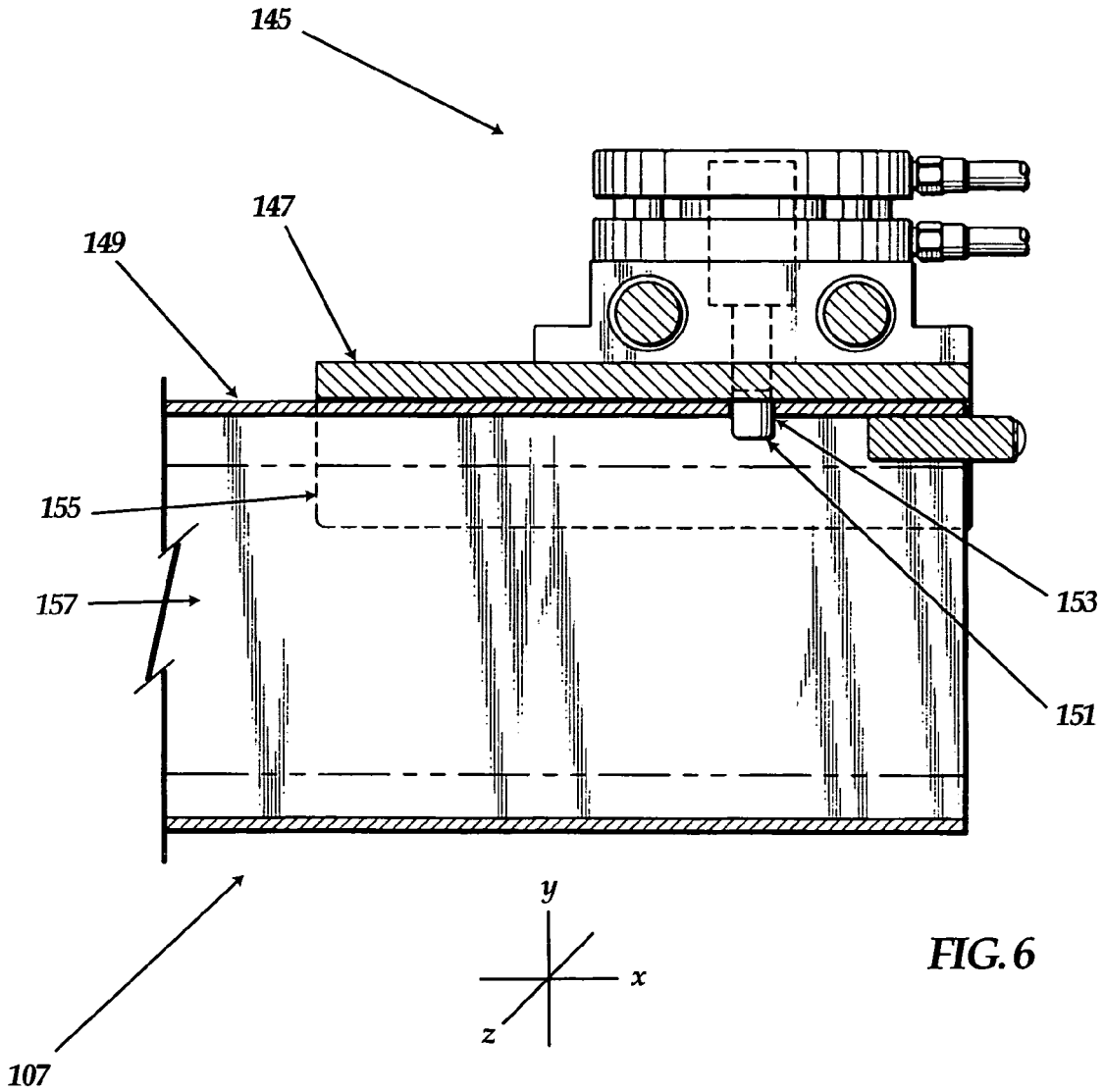
FIG. 6 is a side view of the stud clamp along the line 6-6 in FIG. 5.
Figure 7:
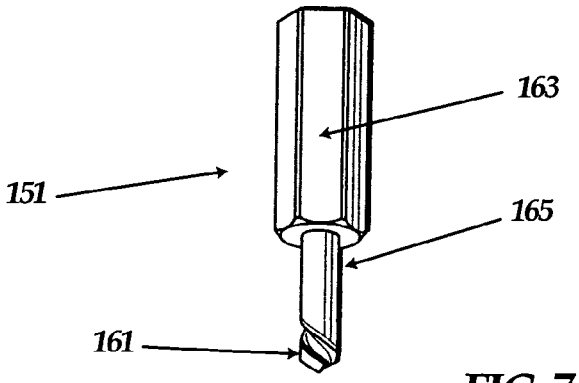
FIG. 7 is a perspective view of an optional configuration of the pin used in the stud clamp.

| | |
|---|---|
| 101 | foam panel |
| 103 | top frame |
| 105 | bottom frame |
| 107 | studs |
| 109 | foam block |
| 111 | kerfs |
| 113 | wallboard |
| 115 | depth |
| 117 | cavity |
| 119 | foam panel machine |
| 121 | deck |
| 123 | stud rollers |
| 125 | stud roller cross members |
| 127 | base |
| 129 | cutting unit |
| 131 | cutting unit guides |
| 133 | cutting unit movement |
| 135 | cutting modules |
| 137 | cutting module cross members |
| 139 | cutting module clamps |
| 141 | blades |
| 143 | rollers |
| 145 | stud clamps |
| 147 | stud clamp cap |
| 149 | stud channel |
| 151 | pin |
| 153 | aperture |
| 155 | stud clamp brace |
| 157 | stud beam |
| 159 | stud lip |
| 161 | bit |
| 163 | driver |
| 165 | shaft |
| 167 | pneumatic actuators |
| 169 | cutting module guides |
| 171 | cutting module mounts |
| 173 | anode |
| 175 | cutter |
| 177 | heat sink |
| 179 | cathode |
| 181 | insulator |
| 183 | intersection |
| 185 | gears |
| 187 | teeth |
| 189 | drive chain |
| 191 | sprocket |
| 193 | motor |
| 195 | driveshaft |
| 197 | cutting unit rollers |
| 199 | cutting unit guide rollers |
| 201 | temperature control unit |

DETAILED DESCRIPTION OF THE INVENTION

The invention as disclosed herein provides a novel apparatus and method for constructing prefabricated foam panels for use in construction. As shown in FIGS. 1 and 2, foam panel 101 has four main components: top frame 103, bottom frame 105, one or more studs 107, and foam block 109. Studs 107 are inserted into kerfs 111 in foam block 109, such kerfs having a substantially similar cross-sectional shape as studs 107. Top frame 103 and bottom frame 105 are secured to studs 107 to form a strong, lightweight, insulated foam panel 101. Foam block 109 forms the exterior surface of foam panel 101. The interior of foam panel 101 is wallboard 113 or other like material such as drywall, fiberboard, or plywood, which is attached to studs 107 on the building site according to the specific architectural design of the building. In order to meet building codes of most locations, studs 107 must be recessed from the exterior of foam block 109 by a minimum predetermined depth 115. In most applications, the attachment of wallboard 113 to studs 107 creates a hollow cavity 117 in which conduit (not pictured) or other in-wall building materials may be installed.

Turning now to FIG. 3, foam panel machine 119 assembles foam panel 101 in an automated fashion. Foam panel machine 119 is generally rectangular in shape, and such shape can be used to create foam panel 101 in virtually any shape. Foam panel machine 119 generally comprises a substantially rectangular deck 121, one or more stud rollers 123, one or more stud roller cross members 125, a base 127, a cutting unit 129, and one or more cutting unit guides 131. Deck 121 and cutting unit guides 131 are mounted to base 127; optionally, deck 121 may be integrated with base 127. The distance between substantially parallel cutting unit guides 131 is equal to or greater in width than deck 121, and the length of cutting unit guides is equal to or greater than the length of deck 121. Cutting unit 129 is mounted between cutting unit guides 131 such that cutting unit 129 is substantially parallel to cutting unit guides 131. Cutting unit 129 is movable along cutting unit guides 131 in a direction parallel to cutting unit guides 131. Stud rollers 123 are selectably mounted to stud roller cross members 125, which may be mounted to deck 121 or base 127.

In order to assemble foam panel 101 using foam panel machine 119, foam block 109 is placed on a deck 121 of foam panel machine 119. Studs 107 are fed onto stud rollers 123 to maintain the studs 107 in a position substantially parallel to cutting unit guides 131 and other studs 107. Cutting unit 129 receives studs 107 and, as cutting unit moves in the direction of cutting unit movement 133, may preferentially push studs 107 into foam block 109 shortly after cutting unit 129 cuts kerfs 111 into foam block 109. Once cutting unit 129 has traversed the length of cutting unit guides 131, studs 107 will be fully inserted into kerfs 111 in foam block 109. Partially assembled foam panel 101 may then be removed from foam panel machine 119, or top frame 103 and bottom frame 105 may be secured to studs 107 while the partially assembled foam panel 101 remains on foam panel machine 119. Optionally, either top frame 103 or bottom frame 105 may be secured to studs 107 prior to the activation of cutting unit 129.

The components of cutting unit 129 are shown in more detail in FIGS. 4-7. Cutting unit 129 is comprised of one or more cutting modules 135. Cutting modules 135 are movably attached to one or more cutting module cross members 137 such that each cutting module 135 may be separated from adjacent cutting modules at predetermined widths, such as sixteen (16") or twenty-four inches (24"). Cutting module clamps 139 secure cutting modules 135 at the predetermined widths along cutting module cross members 137.

Cutting modules 135 are comprised of one or more blades 141. Blades 141 are heated to a temperature capable of vaporizing, or at least melting, a portion of foam block 109 contacting the leading edge of blade 141 to form kerf 111. For a short period of time after blade 141 has formed kerf 111, the foam surrounding kerf 111 remains liquefied. The liquid foam surrounding kerf 111 serves to lubricate the passage of stud 107 into kerf 111.

An optional element of cutting module 135 is one or more rollers 143. Rollers 143 flatten foam blocks 109 immediately prior to when blades 141 contact foam block 109 to ensure a uniform depth 115 of kerf 111. In the best mode known to the inventors, at least two rollers 143 are spaced apart at a distance equal to or greater than the width of stud 107. Such configuration enables the rollers 143 to more efficiently and effectively flatten a section of foam block 109 into which stud 107 will be inserted.

Another optional element of each cutting module 135 is one or more stud clamps 145, which receive studs 107 fed into foam panel machine 119. Stud clamps 145 secure studs 107 in a fixed position relative to cutting module 135 such that cutting unit 129 and studs 107 move substantially as a single unit. In order for stud clamps 145 to secure studs 107 with respect to cutting module 135, stud clamps 145 preferentially maintain at least three points of contact with studs 107 in order to prevent movement in all three dimensions, x, y, and z. A first point of contact between stud clamp 145 and stud 107 is stud clamp cap 147, which has a planar surface that communicates with a planar stud channel 149. Stud clamp cap 147 secures stud 107 against movement in the y plane. A second point of contact between stud clamp 145 and stud 107 is pin 151, which protrudes through an aperture 153 in stud 107. Pin 151, which may be operated pneumatically, hydraulically, or electrically, secures stud 107 against movement in the x plane and assists in limiting movement in the z plane. A third point of contact between stud clamp 145 and stud 107 is stud clamp brace 155, which has a planar surface that communicates with a planar stud beam 157. Stud clamp brace 155 secures stud 107 against movement in the z plane and against pivotal motion around pin 151 in the x plane.

Studs 107 are maintained in a position parallel to one another using one or more points of contact with stud rollers 123, which work in conjunction with stud clamps 145. Stud rollers 123 are preferentially designed to fit snugly within a generally "C"-shaped stud 107 such that stud rollers 123 roll along stud channel 149, the sides of which are bounded by stud beam 157 and a stud lip 159. By engaging studs 107 with stud clamps 145 and stud rollers 123 at separate places along the length of studs 107, studs 107 can be maintained in a parallel configuration in the x, y, and z planes.

Optionally, pin 151 performs the additional step of forcibly punching or drilling aperture 153 in stud 107, rather than requiring stud 107 to be predrilled. Pin 151 may be driven linearly with sufficient force to punch aperture 153 into stud 107. Alternatively, pin 151 may comprise a bit 161 rotatably powered by driver 163 that creates aperture 153. Either way, once aperture 153 is created in stud 107, shaft 165 communicates with aperture 153 in order to create a point of contact with stud 107 in the manner described above. Driver 163 may be a self-powered electric or pneumatic motor, or may receive power from an external source.

For each cutting module 135, stud clamp 145, blade 141, and/or roller 143 may be mounted to a single pneumatic actuator 167, or such components may be mounted to separate pneumatic actuators 167. Persons having skill in the art will recognize that pneumatic actuators 167 are interchangeable with other types of actuating devices, such as hydraulic, electrical, or mechanical devices. Pneumatic actuators 167 are useful in several components and may serve different functions. For instance, one function of pneumatic actuators 167 is to ensure that stud clamps 145 engage studs 107 with sufficient force to draw studs 107 through kerfs 111. Another function of pneumatic actuators is to ensure that rollers 143 apply sufficient downward force to foam blocks 109 to ensure adequate flattening of foam blocks 109. Yet another function of pneumatic actuators 167 is to lift stud clamps 145, rollers 143, and blades 141 so that once foam block 109 has been fully kerfed, cutting unit 129 may be positioned so that foam block 109 may be removed from foam panel machine 119.

Figure 8:
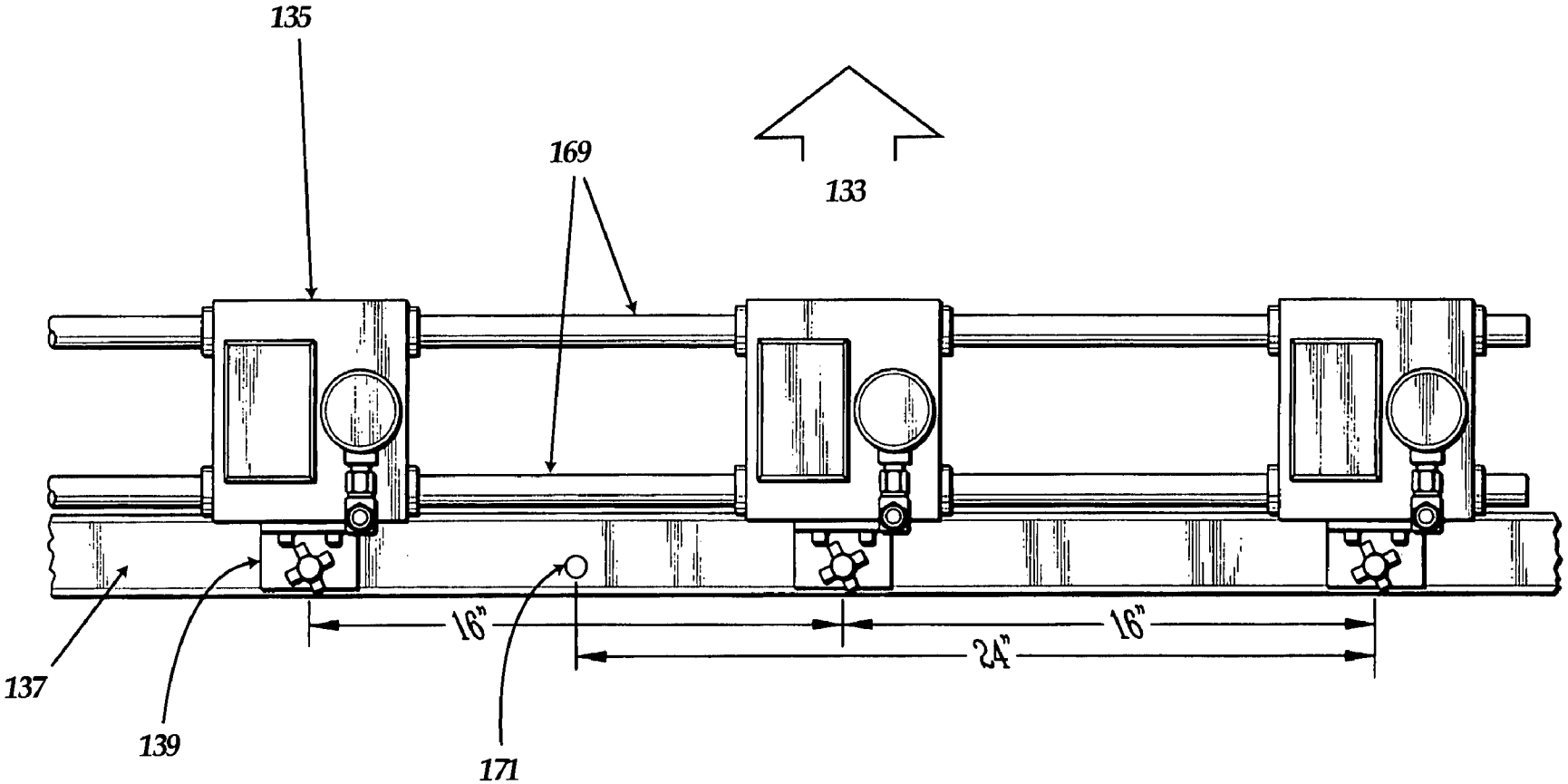
FIG. 8 is a top view of the foam panel machine along the line 8-8 in FIG. 4 with the cutting unit housing removed showing the configuration of stud rollers and cutting modules in relation to studs.
Figure 9:
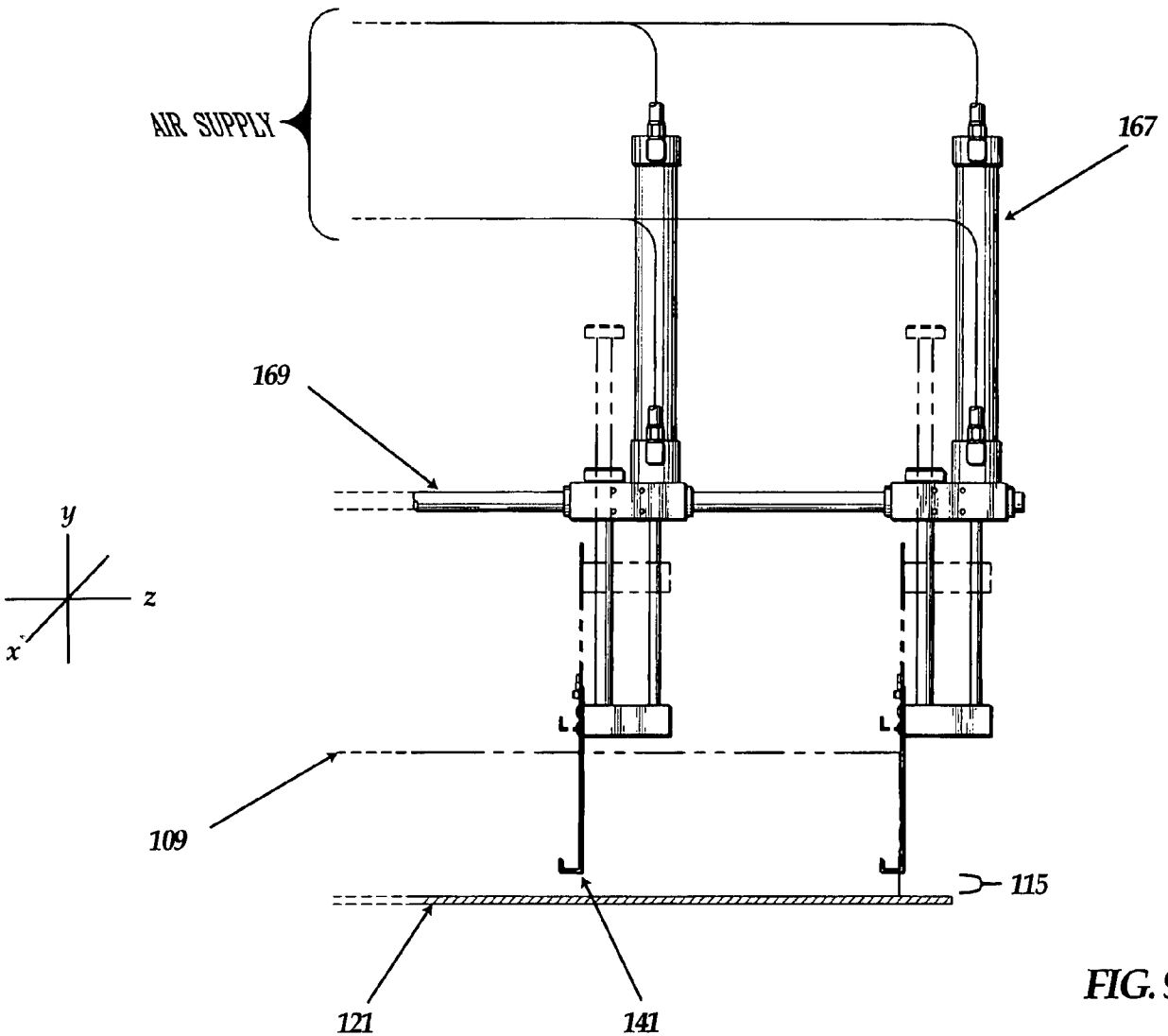
FIG. 9 is a rear view of the foam panel machine with the cutting unit housing removed along the line 9-9 in FIG. 4 showing the configuration of blades and cutting modules in relation to a foam block.

Turning now to FIGS. 8-9, cutting modules 135 are slidably mounted to one or more cutting module guides 169. Cutting modules 135 are moveable along cutting module guides 169 so that each cutting module 135 may be positioned a predetermined distance from other cutting modules 135. When cutting modules 135 are positioned in the desired predetermined location, cutting module clamps 139 engage cutting modules 135 in order to immobilize cutting modules 135 with respect to cutting module cross members 137; such configuration creates a fixed width between kerfs 111 when foam panel machine 119 is activated. By way of example, in residential construction, parallel studs are typically placed sixteen inches (16") apart, a configuration known in the industry as "16-inch centers." However, other types of construction call for 12-, 18, or 24-inch centers, hence the need for adjustable positions of cutting modules 135 (and stud rollers 123). FIG. 8 demonstrates a foam panel machine 119 having a cutting module cross member 137 with cutting module mounts 171 at 16- and 24-inch centers, although centers of virtually any width may be used with foam panel machine 119.

Blades 141 may be positioned throughout a range of positions in the y plane, two of which are depicted by FIG. 9. Pneumatic actuators 167 may movably position blades 141 (as well as stud clamps 145 and rollers 143) for at least two reasons. A first reason is that foam blocks 109 of different thicknesses may be utilized with foam panel machine 119, or building codes may require a different depth 115. A second reason is that blade 141 may be retractable in order for cutting unit 129 to be moved so that foam panel 101 may be removed from foam panel machine 119.

Figure 10:
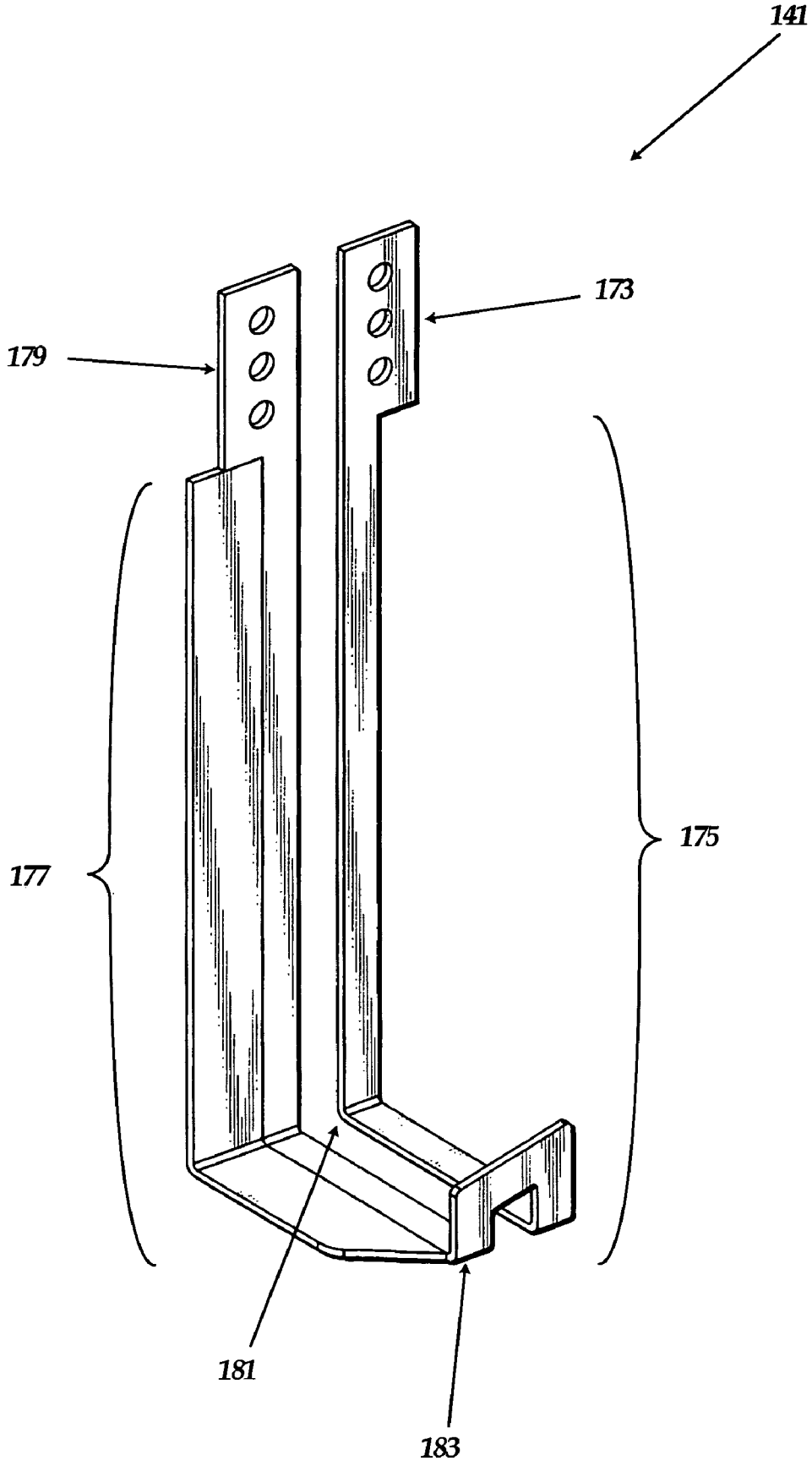
FIG. 10 is a perspective view of the blade used in the automated foam panel machine.

The configuration of blade 141 is shown in more detail in FIG. 10. As stated above, blade 141 is preferably electrically heated. When electrical heat is used, blade 141 acts as a circuit. Such circuit is comprised of anode 173, cutter 175, heat sink 177, and cathode 179. The shape of blade 141 is critical in providing superior cutting properties over hot wire cutters of the prior art because the shape of blade 141 dictates the way in which each element of the circuit performs. During operation of foam panel machine 119, electrical current flows into anode 173 and through cutter 175. As seen in the drawing, cutter 175 is comprised of a relatively long, thin, and flat piece of conductive material. Heat sink 177 is comprised of a length of material that is approximately the same length as cutter 175; however, heat sink 177 is considerably wider, and preferably somewhat thicker, than cutter 175. An electrical insulator 181, which can be a ceramic or a non-conducting gas such as air, separates cutter 175 and heat sink 177 at all points except for intersection 183 of cutter 175 and heat sink 177. The thickness and width of cutter 175 dictates that when current flows through cutter 175, cutter 175 heats to a relatively uniform temperature because the cross section of the conductive material remains substantially the same throughout the length of cutter 175, which means that cutter 175 yields uniform resistance.

After current exits cutter 175 and enters heat sink 177 at intersection 183, which has substantially the same cross sectional area as cutter 175, the cross section of conductive material comprising heat sink 177 increases. The increased cross section as between heat sink 177 and cutter 175 means that the resistance is lower in heat sink 177 than in cutter 175, and thus the temperature of heat sink 177 is substantially lower than cutter 175. The advantages of heat sink 177 are at least twofold: first, heat sink 177 provides a higher bandwidth for current than cutter 175, which assists in maintaining uniform current and thus even temperature throughout cutter 175. Second, because heat sink 177 is thicker and remains at a lower temperature than cutter 175, it remains more rigid than cutter 175; the added thickness and rigidity of heat sink 177 assists in forming the proper shape of kerf 111. After heating cutter 175 and heat sink 177, current flows from heat sink 177 through cathode 179 and out of blade 141.

Depending on the temperature of cutter 175, kerf 111 is formed by vaporizing or melting a portion of foam block 109 around blade 141. During such process, at least a portion of the foam surrounding kerf 111 remains melted after blade 141 continues to move and kerf additional portions of foam block 109. Heat sink 177 may operate to cool such melted foam, which additionally assists in forming the proper shape of kerf 111.

Various conductive materials may be used to construct blades 141. High resistivity is necessary in order to construct a small, thin blade 141 capable of reaching high temperatures. Resistivity values of conductive metals change with temperature. The best mode known to the inventors is to construct blades 141 from Nichrome because Nichrome has a relatively high resistivity of $100\times10^{-8}$ Ω·m at 20° C., yet a relatively low temperature coefficient of 0.0004 (as compared with other readily available metals). The operating temperature ranges discovered to be ideal by the inventors for foam panel machine 119 are 700 to 1200° F. (370 to 650° C.) for cutter 175 and 250 to 500° F. (120 to 260° C.) for heat sink 177, although other operable temperature ranges may be used by adjusting the thickness and width of both cutter 175 and heat sink 177. Resistivity is given by the formula $\rho=\rho_{20}\cdot[1+\alpha\cdot(T_C-20°\text{ C.})]$, where ρ is resistivity, $\rho_{20}$ is resistivity at 20° C., α is temperature coefficient of the metal, and $T_C$ is the temperature of the metal in degrees Celsius. Thus, the resistivity of cutter 175 during operating temperature ranges is 114 to $125\times10^{-8}$ Ω·m, while the resistivity of heat sink 177 during operating temperature ranges is 104 to $110\times10^{-8}$ Ω·m.

The cross-sectional area of cutter 175 may depend on the size and shape of studs 107 to be used. Studs for use in building construction are commonly in the range of 14 to 24 gauge (0.0785 to 0.0276 inches), although sheet metal used in studs 107 can range from 3 to 30 gauge or beyond (0.2391 inches to 0.0100 inches).

For example, studs 107 constructed from 20 gauge galvanized steel have a thickness of 0.0396 inches (1.01 mm). When using 20 gauge galvanized steel, a blade 141 having a thickness of 0.0400 inches (1.02 mm) may be utilized to create kerf 111. Cutter 175 has a length of 7.03 inches (176 mm) and a width of 0.240 inches (6.10 mm), and heat sink 177 has a length of 6.64 inches (169 mm) and a width of 0.710 inches (18.0 mm). The resistance of the parts of blade 141 is given by the formula R=ρL/A, where ρ is resistivity, L is length, and A is cross-sectional area (A=w·h, where w is width and h is thickness). The following table illustrates the resistances realized for cutter 175 and heat sink 177 at operating temperatures:

| Part | $T_{min}$ (° C.) | $T_{max}$ (° C.) | $\rho_{min}$ (Ω · m) | $\rho_{max}$ (Ω · m) | w (mm) | h (mm) | L (mm) | $R_{min}$ Ω | $R_{max}$ Ω |
|---|---|---|---|---|---|---|---|---|---|
| cutter | 370 | 650 | 1.14E−06 | 1.25E−06 | 6.1 | 1.02 | 176 | 3.22E−02 | 3.54E−02 |
| heat sink | 120 | 260 | 1.04E−06 | 1.10E−06 | 18 | 1.02 | 169 | 9.57E−03 | 1.01E−02 |
| Ratio | | | | | | | | 3.37 | 3.51 |

As demonstrated by the above table, the ratio of resistance as between cutter 175 and heat sink 177 is critical in ensuring that cutter 175 remains at proper temperatures during operation of foam panel machine 119. The inventors have found that a ratio of resistance between cutter 175 and heat sink 177 of 3:1 to 4:1 will help to ensure proper heating of cutter 175, and a ratio of 3.3:1 to 3.6:1 is ideal. Nichrome is an ideal metal for forming blade 141 because the ratio of resistance between cutter 175 and heat sink 177 does not vary greatly throughout the operating temperature range of blade 141, although other materials may have suitable resistance characteristics over the operating temperature range of blade 141.

Figure 11:
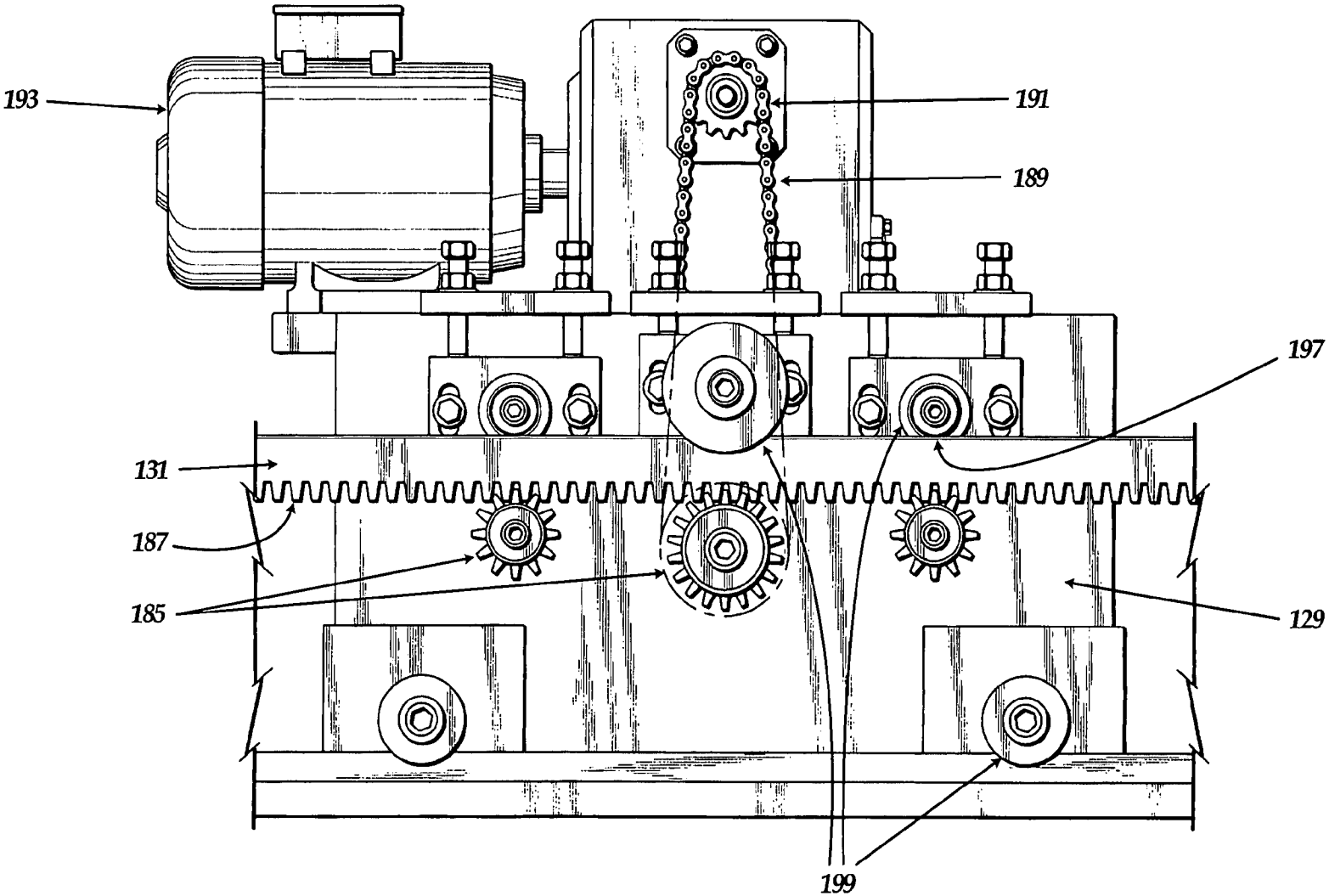
FIG. 11 is a side view of the cutting unit that shows the motor and gearing used to move the cutting unit.
Figure 12:
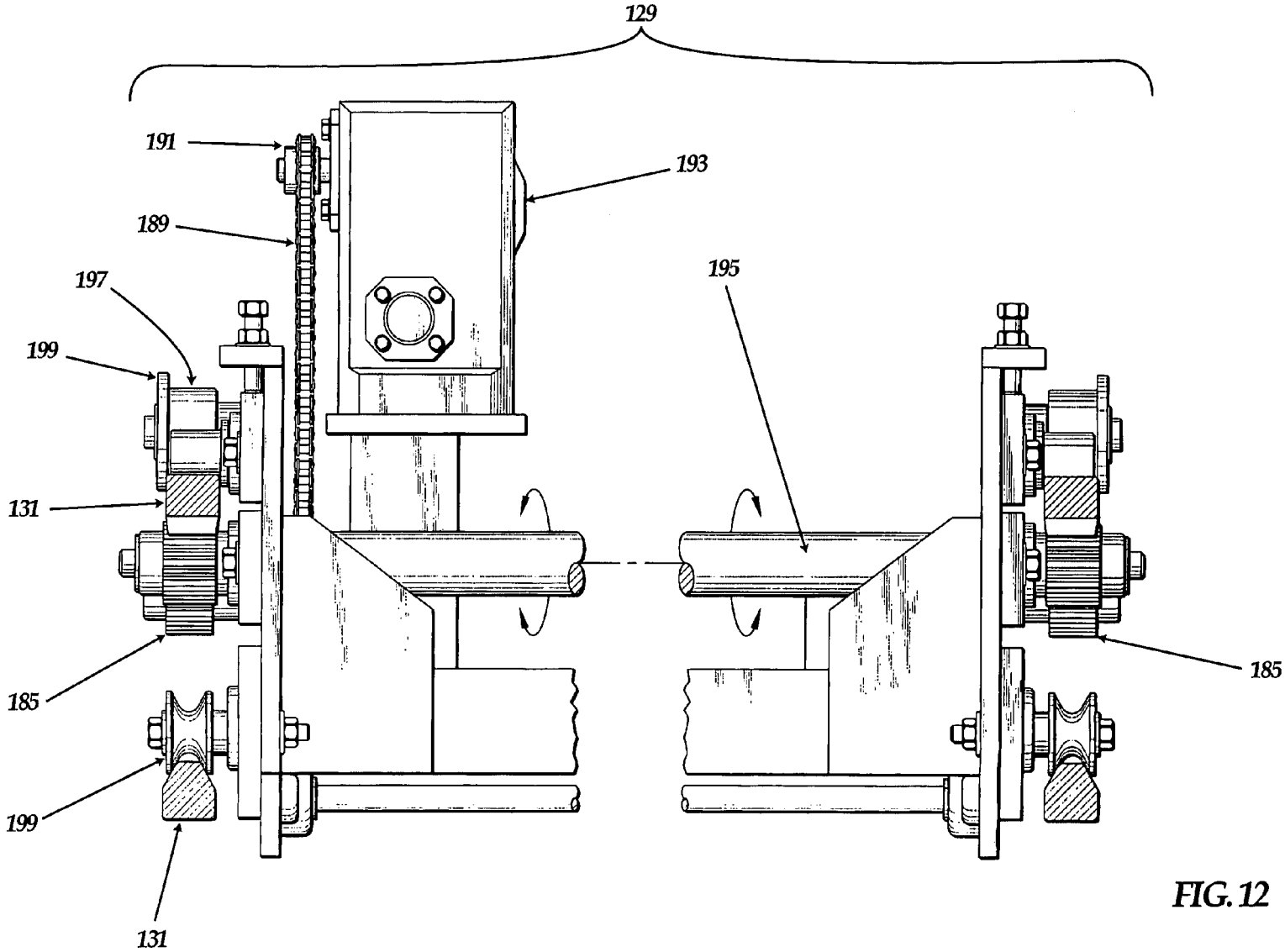
FIG. 12 is a rear view of the cutting unit that shows the motor and gearing used in the automated foam panel machine to feed foam blocks and studs into the machine.

The movement of cutting unit 129 is shown in more detail in FIGS. 11-12. Cutting unit 129 has gears 185 that interface with teeth 187 on one or more of cutting unit guides 131. A drive chain 189 passes over one or more gears and a sprocket 191. Motor 193 provides rotary power to sprocket 191, thus turning drive chain 189 and moving cutting unit 129. Driveshaft 195 distributes rotary power equally between gears 185 on each side of cutting unit 129. In the best mode known to the inventors, teeth 187 are mounted to the bottom of cutting unit guides 131, and the weight of cutting unit 129 is supported by cutting unit rollers 197 that roll along the top of cutting unit guides 131. This configuration reduces the force on gears 185 and teeth 187. A cutting unit guide roller 199 may overlap the edges of cutting unit guides 131 to add lateral stability to cutting unit 129. Cutting unit guide rollers 199 may be standalone components or may be integrated into cutting unit rollers 197.

The process used to produce steel studded foam panels 101 requires at least four main steps: machine preparation, materials loading, machine activation, and capping. The process will be described as performed when all optional components are installed on foam panel machine 119; a person having skill in the art will recognize that steps relying on optional components are likewise optional. The machine preparation stage involves configuring the foam panel machine 119 for a particular job. The type and width of stud 107 may dictate the size of blade 141 used and/or the temperature of blade 141. Studs 107 vary in thickness from 3 to 38 gauge and are made from a variety of materials, including regular steel, galvanized steel, stainless steel, and aluminum. Thickness of sheet metal, as measured in gauge, depends on the type of material; for instance, 14 gauge regular steel studs are 0.0747 inches thick, but 14-gauge aluminum studs are 0.0641 inches thick, a difference of 16.5%. A temperature control unit 201 (shown in FIG. 3) for blades 141 is also configured for the type of foam block 109 used in the process, as high-grade EPS typically requires less heat to cut than low-grade recycled foam. The type and quality of foam block 109 will also dictate how much force is applied to flatten foam block 109 by rollers 143. Cutting modules 135 are set to a predetermined width, such as 16" centers. Cutting unit 129 is positioned in a starting location proximal to stud rollers 123. The length and width of foam block 109 dictate how far cutting unit 129 must travel to fully cut kerf 111 into foam block 109. For purposes of the disclosure of the inventive method, and because metal studded foam panels 101 are typically installed such that studs 107 are oriented in a vertical direction, throughout this specification the dimension of foam block 109 perpendicular to and between cutting unit guides 131 will be referred to as width, while the dimension of foam block 109 in the direction parallel to cutting unit guides 131 and cutting unit movement 133 will be referred to as length. Likewise, longitudinal movement refers to movement along the length of foam block 109. Persons having skill in the art will recognize that such definitions are for the convenience of the reader and should not be construed as a limitation of the apparatus or method disclosed herein or the claims thereto.

The materials loading stage involves positioning materials upon foam panel machine 119 prior to activation. During the materials loading stage, foam block 109 is secured to deck 121, and studs 107 are fed through stud rollers 123 and secured to stud clamps 145. Either top frame 103 or bottom frame 105 may be secured to the end of studs 107 distal to stud clamps 145.

The machine activation stage involves cutting kerf 111 into foam block 109 and inserting studs 107 into kerf 111. Blades 141 are heated to a predetermined temperature dictated by the type of foam block 109 and/or stud 107 used. Cutting unit 129 moves from a starting location proximal to stud rollers 123 in a direction shown by cutting unit movement 133. The best mode known to the inventors has cutting unit 129 moving in only one dimension; however, the inventors contemplate that cutting unit 129 could move in two dimensions to create complicated kerfs in foam blocks 109. Rollers 143 flatten foam block 109. Blades 141 longitudinally cut kerf 111 into foam block 109 by vaporizing and/or melting foam block 109 as cutting unit 129 moves along the length of foam block 109. Temperature control unit 201 for blades 141 monitors the temperature of each blade 141 and adjusts the current flowing through each blade 141 in order to maintain a predetermined temperature. Studs 107 are drawn into kerf 111 as cutting unit 129 moves along the length of foam block 109. Typically, foam block 109 and studs 107 are of substantially equal length; once kerf 111 has been fully formed into foam block 109, blades 141 are cooled; cutting unit 129 continues to move along length of foam block 109 until studs 107 are fully inserted, at which time stud clamps 145 disengage studs 107. Pneumatic actuators raise cutting unit 129 in order to avoid obstruction to completion and removal of foam panel 101 from foam panel machine 119. Preferably, after cutting unit 129 is raised, cutting unit 129 moves to the starting location proximal to stud rollers 123.

The capping stage involves installing top frame 103 and/or bottom frame 105 to studs 107, if such installation was not performed during the materials loading stage. Top frame 103 and bottom frame 105 may be secured to studs 107 using a crimping tool or a rivet gun, although other methods of metal-to-metal joining are known in the art.

While the inventors have described above what they believe to be the preferred embodiments of the invention, persons having ordinary skill in the art will recognize that other and additional changes may be made in conformance with the spirit of the invention and the inventors intend to claim all such changes as may fall within the scope of the invention.

We claim:

1. An apparatus for constructing prefabricated foam panels, comprising:

a foam block positioned on a base;

a cutting unit having one or more heated blades for cutting one or more longitudinal kerfs in the foam block; and a motor for moving the cutting unit along a longitudinal axis of the foam block.

2. The apparatus of claim 1, further comprising one or more rollers for flattening the foam block.

3. The apparatus of claim 1, further comprising one or more stud clamps capable of engaging and drawing studs into the kerfs.

4. The apparatus of claim 1, further comprising:

one or more stud clamps capable of engaging and drawing studs into the kerfs; and one or more stud rollers to maintain alignment of the studs as the studs are drawn into the kerfs.

5. A rigid blade for kerfing foam, comprising:

An anode;

A cutter joined to the anode;

A heat sink joined to the cutter at an intersection having a cross sectional area substantially equal to the cross sectional area of the cutter;

An insulator separating the cutter and heat sink; and

A cathode joined to the heat sink.

6. The blade of claim 5, in which the ratio of resistance between the cutter and the heat sink is between 3:1 and 4:1.

7. The blade of claim 5, in which the ratio of resistance between the cutter and the heat sink is between 3.3:1 and 3.6:1.

8. The blade of claim 5, further comprising the cutter and heat sink formed in the shape of the cross section of a metal stud.

* * * * *